US011840422B2

(12) United States Patent
Uccellani et al.

(10) Patent No.: US 11,840,422 B2
(45) Date of Patent: Dec. 12, 2023

(54) REEL BRAKING SYSTEM

(71) Applicant: MACNAUGHT PTY LTD, New South Wales (AU)

(72) Inventors: Marco Uccellani, New South Wales (AU); Prabhjot Singh, New South Wales (AU)

(73) Assignee: MACNAUGHT PTY LTD, New South Wales (AU)

( * ) Notice: Subject to any disclaimer, the term of this patent is extended or adjusted under 35 U.S.C. 154(b) by 485 days.

(21) Appl. No.: 16/636,838

(22) PCT Filed: Aug. 20, 2018

(86) PCT No.: PCT/AU2018/050880
§ 371 (c)(1),
(2) Date: Feb. 5, 2020

(87) PCT Pub. No.: WO2019/036750
PCT Pub. Date: Feb. 28, 2019

(65) Prior Publication Data

US 2020/0369490 A1 Nov. 26, 2020

(30) Foreign Application Priority Data

Aug. 21, 2017 (AU) ..... 2017903360

(51) Int. Cl.
*B65H 75/44* (2006.01)
*F04C 2/10* (2006.01)
(Continued)

(52) U.S. Cl.
CPC ..... *B65H 75/4442* (2013.01); *F04C 2/10* (2013.01); *F04C 2/102* (2013.01); *F04C 14/24* (2013.01);
(Continued)

(58) Field of Classification Search
CPC ..... B65H 75/4442; B65H 2403/7252; F04C 2/10; F04C 2/102; F04C 14/24;
(Continued)

(56) References Cited

U.S. PATENT DOCUMENTS 3,519,248 A * 7/1970 Eishiro ..... B66D 5/026 254/377
4,199,305 A 4/1980 Pareja
(Continued)

FOREIGN PATENT DOCUMENTS

CN 1175470 A 3/1998
CN 2814004 Y 9/2006
(Continued)

OTHER PUBLICATIONS

Chinese Office Action for CN 201880055036.6 dated Mar. 16, 2021; (no English translation).
(Continued)

*Primary Examiner* — Dominick L Plakkoottam
*Assistant Examiner* — Paul W Thiede
(74) *Attorney, Agent, or Firm* — Bryan D. Zerhusen; Nicholas R. Herrel; CANTOR COLBURN

(57) ABSTRACT

A braking system for a hose or cable reel including a housing configured to fit inside a drum of the reel and to rotate with the drum during use, and a gerotor including inner and outer gears disposed inside the housing, wherein the inner gear is attachable to a shaft of the reel and the outer gear is configured to rotate relative to the inner gear with the housing during use thereby causing hydraulic fluid to be pumped through the gerotor and impede rotation of the drum.

20 Claims, 6 Drawing Sheets

(51) Int. Cl.
*F04C 14/24* (2006.01)
*F04C 14/04* (2006.01)
*A62B 1/12* (2006.01)

(52) U.S. Cl.
CPC ..... *A62B 1/12* (2013.01); *B65H 2403/7252* (2013.01); *F04C 14/04* (2013.01); *F04C 2210/206* (2013.01); *F04C 2240/60* (2013.01); *F04C 2240/605* (2013.01); *F04C 2270/205* (2013.01)

(58) Field of Classification Search
CPC ..... F04C 14/04; F04C 2210/206; F04C 2240/60; F04C 2240/605; F04C 2270/205; A62B 1/12
See application file for complete search history.

(56) References Cited

U.S. PATENT DOCUMENTS

| | | | | |
|---|---|---|---|---|
| 4,474,544 | A | 10/1984 | White, Jr. | |
| 5,007,599 | A * | 4/1991 | Forsyth | B65H 75/4489 254/377 |
| 5,494,133 | A * | 2/1996 | Green | A62B 1/12 182/233 |
| 5,531,246 | A | 7/1996 | Ritter | |
| 5,904,371 | A * | 5/1999 | Koning | B60R 22/415 280/806 |
| 5,941,788 | A | 8/1999 | Shaffer et al. | |
| 6,234,417 | B1 | 5/2001 | Sauder et al. | |
| 6,238,315 | B1 | 5/2001 | Morse et al. | |
| 6,488,224 | B1 | 12/2002 | Hiebenthal | |
| 6,752,342 | B1 * | 6/2004 | Nagler | B65H 75/4478 242/390.5 |
| 6,895,855 | B2 | 5/2005 | Doll | |
| 7,370,483 | B2 * | 5/2008 | Sienel | F25B 9/008 62/149 |
| 7,370,843 | B2 * | 5/2008 | Dueck | B66D 1/06 254/277 |
| 9,656,832 | B2 | 5/2017 | Morgan et al. | |
| 2002/0171001 | A1 | 11/2002 | Hiebenthal | |
| 2007/0158139 | A1 | 7/2007 | Moon | |
| 2007/0267612 | A1 | 11/2007 | Dueck | |
| 2008/0164361 | A1 | 7/2008 | Fancher | |
| 2012/0051960 | A1 | 3/2012 | Nakamura et al. | |
| 2014/0263801 | A1 * | 9/2014 | Skowronski | B65H 75/4449 242/397.5 |
| 2016/0084274 | A1 | 3/2016 | Afshari | |

FOREIGN PATENT DOCUMENTS

| | | | |
|---|---|---|---|
| CN | 101061327 | A | 10/2007 |
| CN | 201047365 | Y | 4/2008 |
| CN | 106943682 | A | 7/2017 |
| DE | 20221032 | U1 | 10/2004 |
| DE | 102009043964 | A1 | 9/2010 |
| DE | 10 2013 203331 | A1 | 8/2014 |
| DE | 10 2014 111133 | A1 | 2/2016 |
| EP | 1144868 | A1 | 10/2001 |
| EP | 1 279 637 | A2 | 1/2003 |
| JP | 49096595 | A | 9/1974 |
| JP | 49127100 | U | 10/1974 |
| JP | 04046227 | A | 2/1992 |
| JP | 06147237 | A | 5/1994 |
| JP | 2006056619 | A | 3/2006 |
| WO | WO 2008/031012 | A2 | 3/2008 |
| WO | WO 2014/094066 | A1 | 6/2014 |

OTHER PUBLICATIONS

Extended European Search Report for EP18848899.3 dated, Apr. 6, 2021.
International Search Report and Written Opinion for PCT/AU2018/050880 dated Nov. 15, 2018.

* cited by examiner

REEL BRAKING SYSTEM

CROSS-REFERENCE TO RELATED APPLICATIONS

This application is a National Stage of PCT/AU2018/050880, filed 20 Aug. 2018, titled REEL BRAKING SYSTEM, published as International Patent Application Publication No. WO 2019/036750 A1, which claims the benefit of and priority to Australian Patent Application No. 2017903360, filed on 21 Aug. 2017, both of which are incorporated herein by reference in their entirety for all purposes.

FIELD

The present invention relates to a braking system for a hose or cable reel.

BACKGROUND

Hose and cable reels are used in a wide range of industries for improving workplace safety and efficiency. Unwound hoses and cables present trip and slip hazards that can cause personal injury to staff. This can lead to workplace compensation claims and reduced productivity. Reel devices help ensure a neat and tidy workplace and allow hoses and cables to be conveniently stored, retracted and used.

A typical reel comprises a drum that the hose or cable is wound around. The drum rotates about a shaft extending through a centre of the drum that remains static during use. Pulling on the hose causes the drum to rotate and the hose or cable to unwind from the reel so that it may then be used.

A reel drum may also comprise a spring-driven retraction mechanism that causes the drum to rotate in the opposite direction automatically when the user moves the hose or cable back towards the drum following use. Automatic retraction mechanisms also present risks to users of hose and cable reels. For example, if a user accidently lets go of a hose during retraction, the rotational speed of the drum may accelerate uncontrollably causing the hose to whip around in a dangerous manner and come into contact with the person or others standing nearby.

In this context, there is a need for a braking system for controlling the speed at which hoses and cables are retracted into reels.

SUMMARY

According to the present invention, there is provided a braking system for a hose or cable reel comprising:

a housing configured to fit inside a drum of the reel and to rotate with the drum during use; and a gerotor comprising inner and outer gears disposed inside the housing, wherein the inner gear is attachable to a shaft of the reel and the outer gear is configured to rotate relative to the inner gear with the housing during use thereby causing hydraulic fluid to be pumped through the gerotor and impede rotation of the drum.

The housing may comprise fluid inlet and outlet orifices opening into an inside of the housing, wherein the braking system further comprises:

first and second conduits in fluid communication with, respectively, the inlet and outlet orifices; and a valve configuration connected to respective ends of the first and second conduits, the valve configuration being configured to limit flow of hydraulic fluid from the first conduit to the second conduit through the valve configuration, wherein, in use, the gerotor causes hydraulic fluid to be sucked into the housing from the first or second conduit and then pumped out of the housing into the other conduit, depending on the direction of rotation of the drum.

The valve configuration may comprise a check valve and a flow control valve configured such that when hydraulic fluid flows through the valve configuration:

from the first to the second conduit, more hydraulic fluid flows through the flow control valve than through the check valve; and from the second to the first conduit, more hydraulic fluid flows through the check valve than through the flow control valve.

The check valve may be configured such that hydraulic fluid cannot flow through the check valve when flowing from the first to the second conduit through the valve configuration.

The valve configuration may further comprise first and second internal conduits, each internal conduit being in fluid communication with the respective ends of the first and second conduits, and wherein:

the flow control valve controls the flow of hydraulic fluid through the first internal conduit; and the check valve controls the flow of hydraulic fluid through the second internal conduit.

The valve configuration may comprise a pressure compensator and a flow control valve configured such that when hydraulic fluid flows through the valve configuration: from the first to the second conduit, hydraulic fluid flow can be controlled by the pressure compensator; and from the second to the first conduit, hydraulic fluid flow is not controlled by the pressure compensator.

The pressure compensator may comprise: a spool, displaceable between an open position, wherein flow of hydraulic fluid through the valve configuration is not controlled by the pressure compensator, and a closed position, wherein hydraulic fluid is prevented from flowing through the valve configuration; and a spring, arranged to bias the spool to the open position.

The valve configuration may further comprise: a first pressure conduit in fluid communication with a first side of the flow control valve and a first end of the spool, wherein backpressure at the first side of the flow control valve generated by hydraulic fluid flowing through the flow control valve forces the spool towards the open position; and a second pressure conduit in fluid communication with a second side of the flow control valve and a second end of the spool, wherein backpressure at the second side of the flow control valve generated by hydraulic fluid flowing through the flow control valve forces the spool towards the closed position.

The braking system may further comprise an elongate sleeve connected to the inner gear, wherein the elongate sleeve is axially aligned with the shaft of the reel and comprises an internal lumen configured to receive the shaft for securing the inner gear to the shaft.

A braking force of the braking system may be governed by the flow control valve.

A braking force of the braking system may be governed by a size of the inlet orifice.

A braking force of the braking system may be governed by a size of the outlet orifice.

A braking force of the braking system may be governed by a viscosity of hydraulic fluid flowing in the braking system.

Hydraulic fluid flowing in the braking system may comprise oil.

The housing may be releasably attachable to the drum.

The housing may be substantially cylindrical.

The housing may be made of plastic.

The valve configuration and first and second conduits may be integrally formed within the housing.

BRIEF DESCRIPTION OF DRAWINGS

Embodiments of the invention will now be described by way of example only with reference to the accompanying drawings, in which.

DESCRIPTION OF EMBODIMENTS

Figure 1:
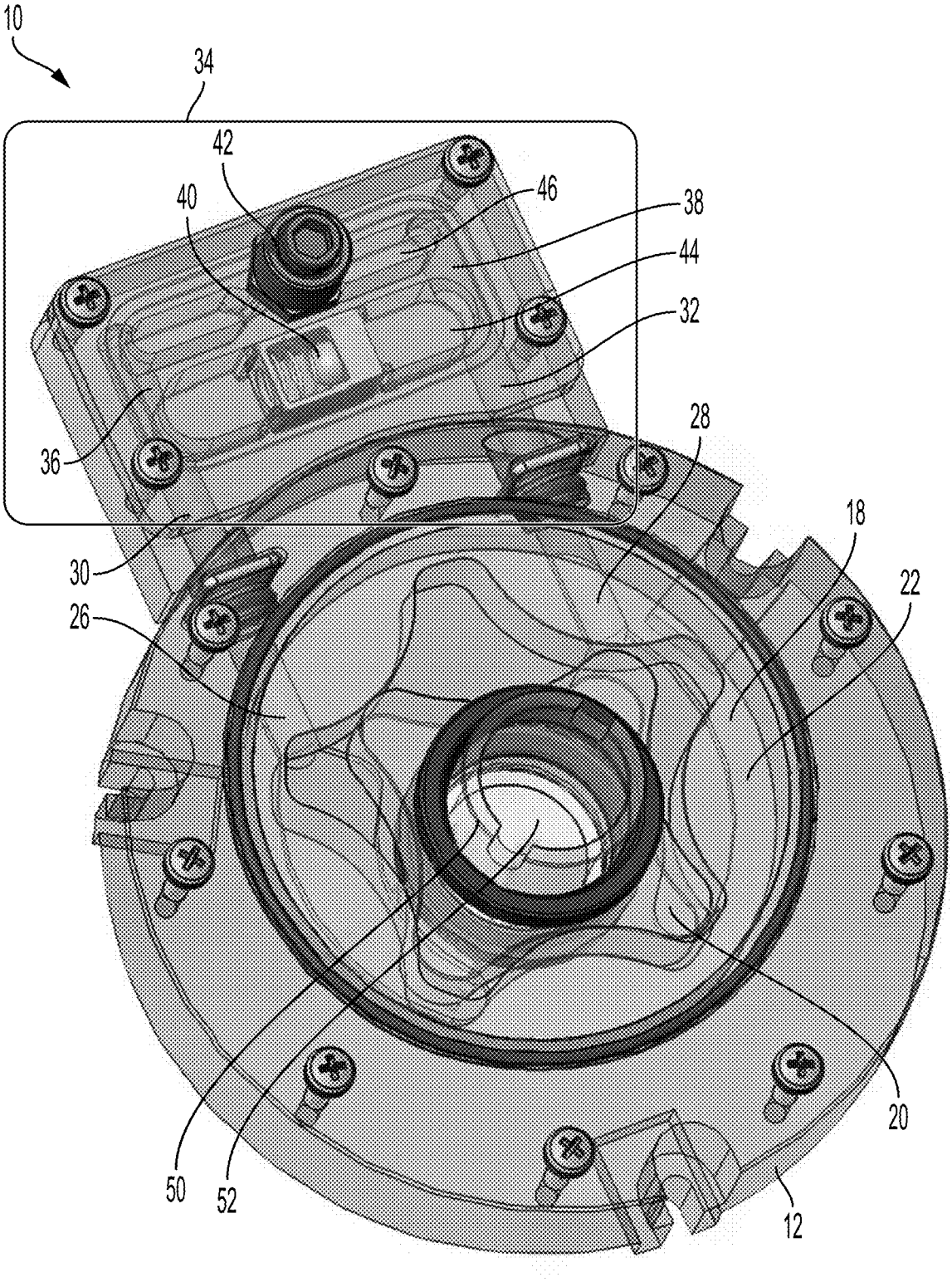
FIG. 1 is an elevated view of a braking system according to an embodiment of the invention.
Figure 2:
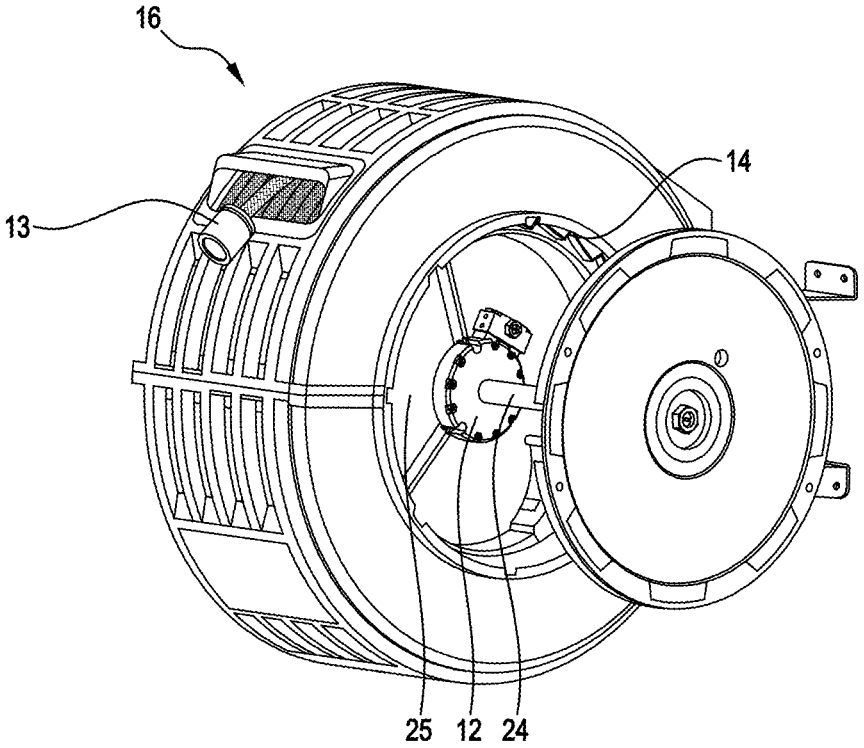
FIG. 2 is an elevated view of a hose reel into which the braking system may be installed.

Referring to the drawings, an example embodiment of the present invention provides a braking system 10 comprising a housing 12, configured to fit inside a drum 14 of a reel 16 having a hose or cable 13, and to rotate with the drum 14 during use. The braking system 10 further comprises a gerotor 18 comprising an inner gear 20 and an outer gear 22 disposed inside the housing 12. The inner gear 20 is attachable to a shaft 24 of the reel 16 and the outer gear 22 is configured to rotate relative to the inner gear 20 with the housing 12 during use thereby causing hydraulic fluid to be pumped through the gerotor 18 and impede rotation of the drum 14.

More particularly, the housing 12 may be substantially cylindrical and made of plastic and configured such that it may be installed directly into an inside 25 of the reel 16 and attached to the drum 14. In one example, the housing 12 may be releasably attachable to the drum 14. In one example, the housing 12 may comprise a plurality of clip members (not shown) disposed about a peripheral edge of the housing 12 configured to engage with a plurality of complementary flanges (not shown) disposed on an inside wall of the drum 14 for releasably attaching the housing 12 to the drum 14. In one example, the housing 12 may be releasably attachable to the drum 14 using a plurality of screws (shown) or nuts and bolts (not shown) configured to fasten the peripheral edge of the housing 12 to the inside wall of the reel 16.

The braking system 10 includes a means for supplying hydraulic fluid to the gerotor 18. As shown schematically in FIG. 3, in one example the housing 12 may have fluid inlet and outlet orifices 26, 28 opening into an inside of the housing 12 and the braking system 10 may comprise first and second fluid-carrying conduits 30, 32 in fluid communication with, respectively, the inlet and outlet orifices 26, 28. In use, relative rotation between the inner 20 and outer gears 22 of the gerotor 18, when operating in one direction, causes hydraulic fluid to be sucked into the housing 12 from the first conduit 30 and subsequently pumped out of the housing 12 into the second conduit 32. When operating in the opposite direction, hydraulic fluid is caused to be sucked into the housing 12 from the second conduit 32 and subsequently pumped out of the housing 12 into the first conduit 30.

The braking system 10 also includes a means for controlling flow of hydraulic fluid to and from the gerotor 18. In some example embodiments, the braking system 10 may further comprise a valve configuration 34, 134, 234 connected to terminal ends 36, 38 of the first and second conduits 30, 32. The valve configuration 34, 134, 234, may be configured to limit flow of hydraulic fluid from the first conduit 30 to the second conduit 32 through the valve configuration 34, 134, 234 during use. That is, the valve configuration 34, 134, 234 ensures that a greater degree of resistance is offered to hydraulic fluid when flowing from the first conduit 30 to the second conduit 32 as compared to when flowing in the opposite direction from the second conduit 32 to the first conduit 30 through the valve configuration 34, 134, 234.

In one example, the valve configuration 34 may comprise a check valve 40 and a flow control valve 42. The valve configuration 34 may further comprise first and second internal conduits 44, 46, each connected to the terminal ends 36, 38 of the first and second conduits 30, 32, in fluid communication with, respectively, the check valve 40 and the flow control valve 42.

The check valve 40 and flow control valve 42 are configured to control the flow of hydraulic fluid through, respectively, the first and second internal conduits 44, 46. In one example, the check valve 40 may provide that hydraulic fluid in the first internal conduit 44 may only flow, or may only substantially flow, through the check valve 40 in the direction from the second conduit 32 towards the first conduit 30 (i.e., from the right side to left side of the schematic drawing in FIG. 3). In this example, when hydraulic fluid flows in the first internal conduit 44 in the opposite direction, the check valve 40 does not allow any hydraulic fluid to pass through the check valve 40, or may only allow a negligible amount of hydraulic fluid to pass through.

In contrast to the check valve 40, the flow control valve 42 provides that hydraulic fluid in the second internal conduit 46 may flow through flow control valve 42 in any direction. However, the flow control valve 42 is configured such that it offers a degree of resistance to the hydraulic fluid when flowing through the flow control valve 42 in either direction.

The check valve 40 and flow control valve 42, together, provide that when hydraulic fluid flows through the valve configuration 34 in the direction from the first conduit 30 to the second conduit 32, more hydraulic fluid flows through the flow control valve 42 than through the check valve 40. This provides that a degree of resistance is offered to the flow of hydraulic fluid, by virtue of the flow control valve 42, when flowing through the valve configuration 34 in this direction. Further, when hydraulic fluid flows through the valve configuration 34 in the opposite direction (i.e., from the second conduit 32 to the first conduit 30) more hydraulic fluid flows through the check valve 40 than through the flow control valve 42. This provides that substantially less resistance is offered to the hydraulic fluid when flowing through the valve configuration 34 in this direction. The combination of first internal conduit 44 and check valve 40 may be configured such that hydraulic fluid flows substantially freely from the second conduit 32 to the first conduit 30 and that accordingly almost no resistance is offered to the hydraulic fluid when flowing through the valve configuration 34 in this direction.

Figure 4:
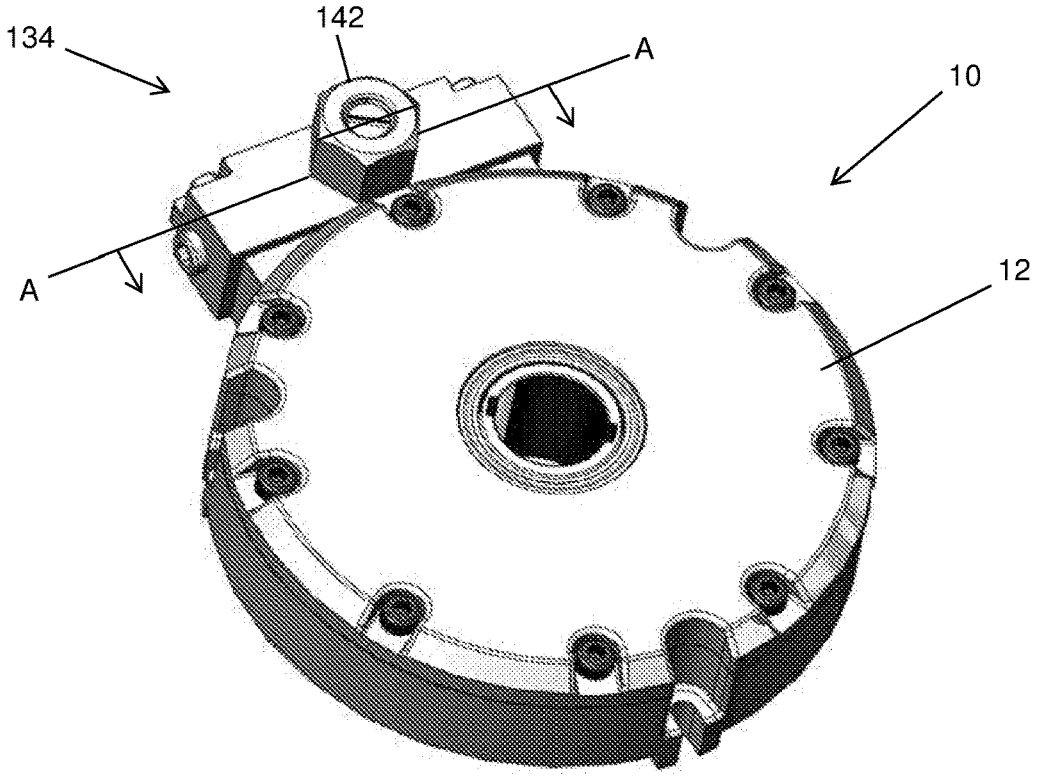
FIG. 4 is an elevated view of a braking system according to another embodiment of the invention.
Figure 5:
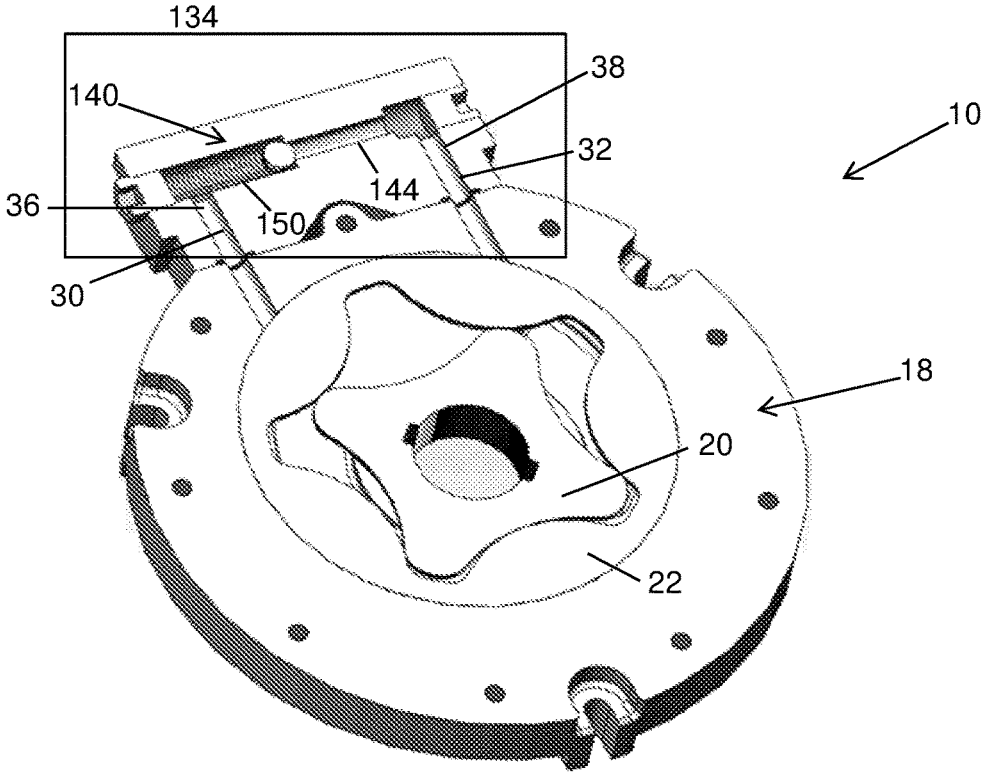
FIG. 5 is a cross section view of the braking system of FIG. 4.
Figure 6:
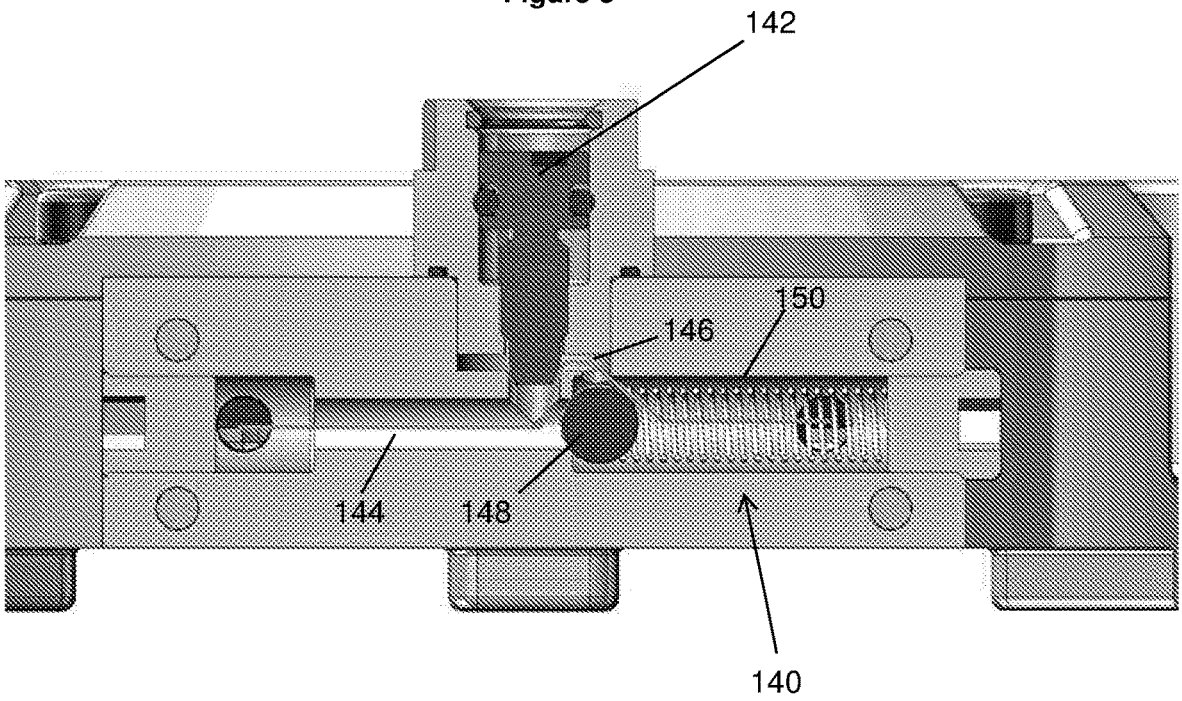
FIG. 6 is a cross section view along line A-A of the braking system of FIG. 4.
Figure 7:
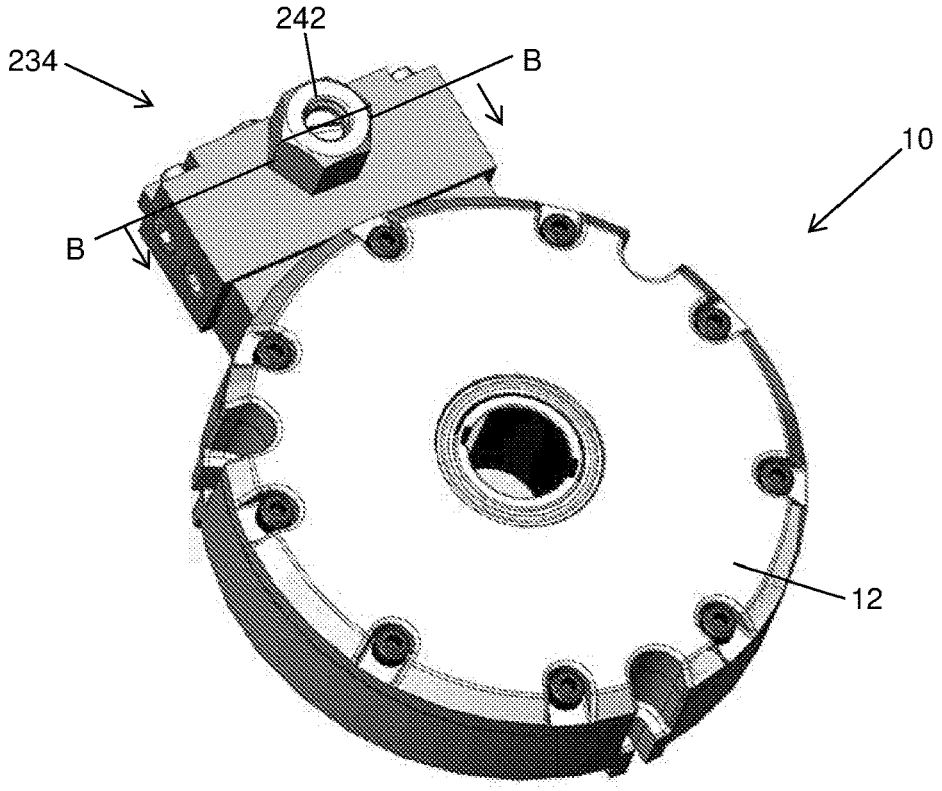
FIG. 7 is an elevated view of a braking system according to another embodiment of the invention.
Figure 8:
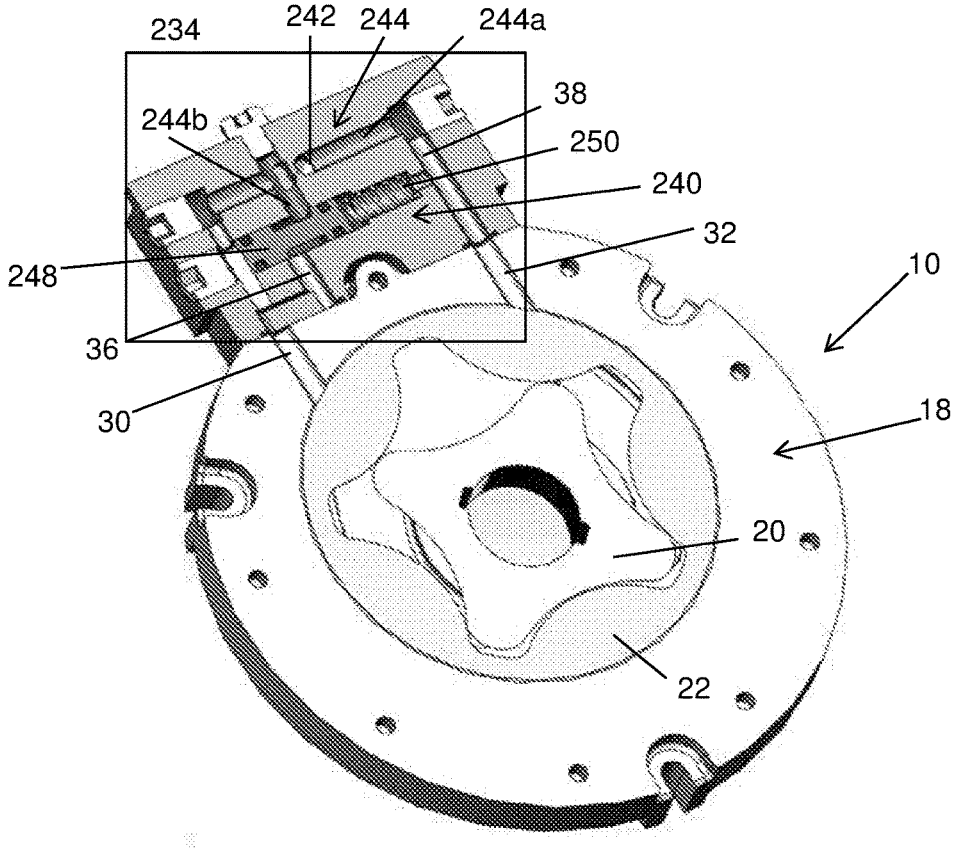
FIG. 8 is a cross section view of the braking system of FIG. 7.

Referring to FIGS. 4 to 6, in one example, valve configuration 134 may comprise first internal conduit 144 connected to the terminal ends 36, 38 of the first and second conduits 30, 32 in fluid communication with check valve 140. Check valve 140 may comprise a ball 148 and spring 150. Example valve configuration 134 may comprise second internal conduit 146 connected in parallel to the first internal conduit 144 in fluid communication with flow control valve 142. Second internal conduit 146 may be connected to the first internal conduit 144 on either side of ball 148 of check valve 140, when check valve 140 is in a closed position.

Referring to FIG. 6, in one example, flow control valve 142 may be arranged to, at least partially, control flow through both the first and second internal conduits 144, 146.

Referring to FIGS. 7 to 10, in one example, valve configuration 234 may comprise a pressure compensator 240 and a flow control valve 242. The flow control 242 may be an orifice valve. The valve configuration 234 may further comprise an internal conduit 244 connected to the terminal ends 36, 38 of the first and second conduits 30, 32. Both the pressure compensator 240 and the flow control valve 242 may be arranged within internal conduit 244 to control hydraulic fluid flow through the internal conduit 244.

The valve configuration 234 may comprise an internal chamber 252 in flow communication with the internal conduit 244. The pressure compensator 240 may be housed within the internal chamber 252. The pressure compensator 240 may comprise a spool 248 and a spring 250. The spool 248 may be configured to regulate hydraulic fluid flow through the internal chamber 252 and through the internal conduit 244. The spool 248 may be displaceable between an open position, where hydraulic fluid can flow through the internal chamber 252 via the internal conduit 244, and a closed position, where hydraulic fluid is prevented from flowing through the internal chamber 252 and the internal conduit 244. The spring 250 may be configured to bias the spool 248 to the open position, as, for example, shown in FIGS. 8 and 9.

The valve configuration 234 may comprise first and second pressure conduits 254, 256 in fluid communication with the internal conduit 244. The first pressure conduit 254 may provide fluid communication between a first section of internal conduit 244*a* on one side of the flow control valve 242 and a first end of spool 248 within the internal chamber 252. The second pressure conduit 256 may provide fluid communication between a second section of internal conduit 244*b* on the other side of the flow control valve 242 and a second end of spool 248 within the internal chamber 252.

Figure 9:
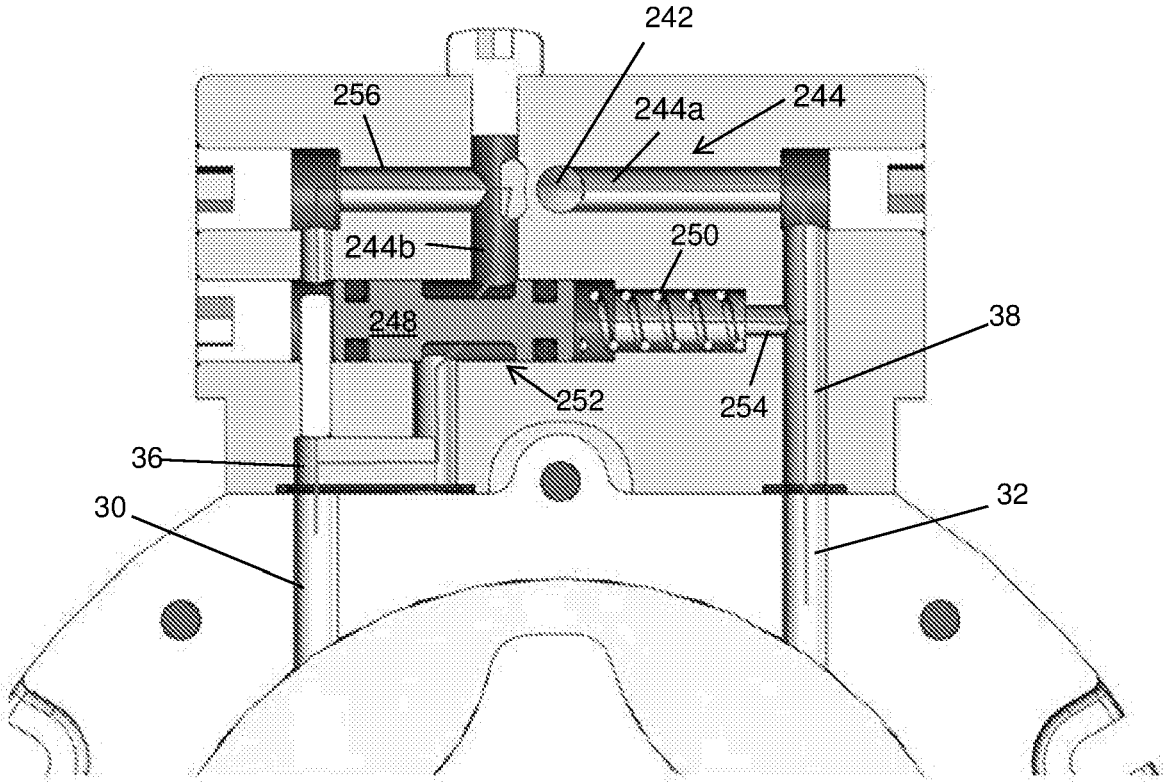
FIG. 9 is an enlarged view of a valve configuration shown in FIG. 8.
Figure 10:
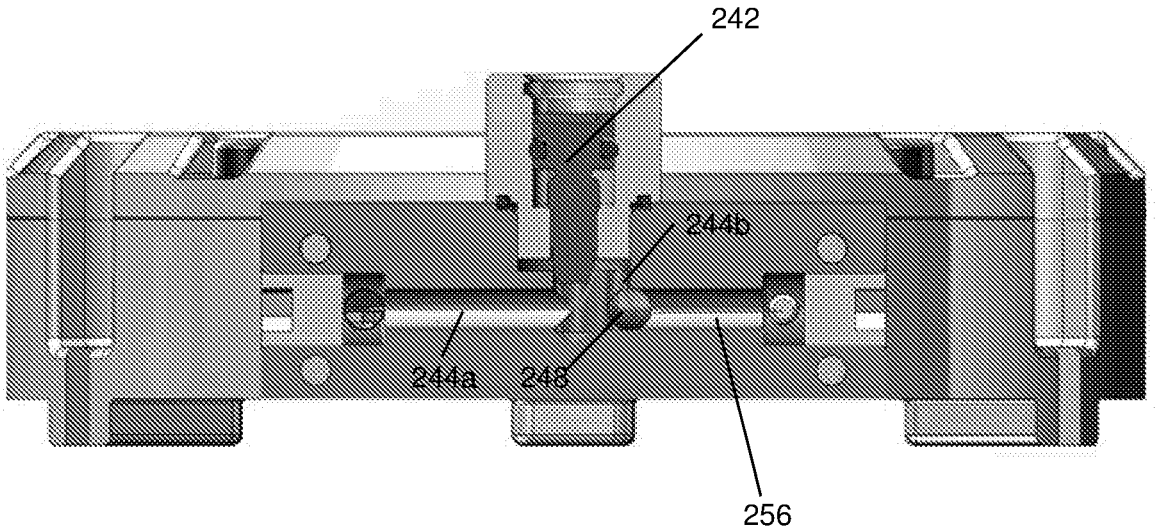
FIG. 10 is a cross section along line B-B of the braking system of FIG. 7.

In one example, the pressure compensator 240 may provide that more hydraulic fluid flows through the internal conduit 244 when flowing from the second conduit 32 to the first conduit 30 than when hydraulic fluid flows from the first conduit 30 to the second conduit 32. In some embodiments, for example as shown in FIG. 9, when hydraulic fluid flows from the second conduit 32 to the first conduit 30 through the first section of internal conduit 244*a*, a backpressure may result when the hydraulic fluid flows through the constraint of flow control valve 242. Any resulting backpressure is transferred to first pressure conduit 254. The combination of backpressure within first pressure conduit 254 and spring 250 forces spool 248 to the open position, allowing unrestricted flow of hydraulic fluid through the internal chamber 252. Accordingly, for the example embodiment, when fluid is flowing from the second conduit 32 to the first conduit 30, the flow of hydraulic fluid is only impeded and controlled by the flow control valve 242 and is not controlled by the pressure compensator 240.

Conversely, when hydraulic fluid flows from the first conduit 30 to second conduit 32 through the second section of internal conduit 244*b*, a backpressure may again result when the hydraulic fluid flows through the constraint of flow control valve 242. In this instance, any resulting backpressure is transferred to the second pressure conduit 256. When the force applied to spool 248 by the backpressure in the second pressure conduit 256 is large enough to overcome the force of spring 250, spool 248 is forced from the open position toward a closed position, at least partially restricting flow of hydraulic fluid through the internal chamber 252 and the second section of internal conduit 244*b*. When flow through the internal chamber 252 is restricted by the spool 248, the flow through flow control valve 242 is equally reduced. Accordingly, the backpressure in second pressure conduit 256 is reduced, resulting in the spool 248 being forced toward the open position by spring 250. The position of spool 248 may therefore oscillate within boundaries of the open position and the closed position, when the force of backpressure in the second pressure conduit 256, created by restrained flow through the flow control valve 242, is large enough to overcome the force of spring 250.

Advantageously, the oscillating spool 248 creates a self-governing system which may maintain a constant flow of hydraulic fluid for a changing hydraulic load. A constant flow results in a constant drum rotation speed and/or consistent reel retraction speed.

In one example, the valve configuration 34, 134, 234 and the first and second conduits 30,32 may be integrally formed within the housing 12. This advantageously enables the housing 12 to be installed into the drum 14 of the reel 16 with ease, and allows the braking system 10 to operate, without the valve configuration 34 or first and second conduits 30,32 getting in the way.

Referring to FIG. 1, the braking system 10 may further comprise an elongate sleeve 50 connected to the inner gear 20. The elongate sleeve 50 is axially aligned with the shaft 24 of the reel 16 and comprises an internal lumen 52 configured to receive the shaft 24 for securing the elongate sleeve 50 and inner gear 20 to the shaft 24.

In use, to install the braking system 10 into the reel 16, the housing 12 is firstly placed into the drum 14 and the shaft 24 of the reel 16 is inserted through the lumen 52 of the elongate sleeve 50. The peripheral edge of the housing 12 is then attached to the inside wall of the drum 14.

When a person needs to extend the hose 13 from the reel 16, the user pulls on the hose 13 which causes the drum 14 to rotate and the hose 13 to unwind from the reel 16. While the drum 14 is rotating, the peripheral edge of the housing 12 (and, therefore, by extension the outer gear 22 of the gerotor 18) is caused to rotate with the drum 14. Because the inner gear 20 of the gerotor 18 is attached to the shaft 24, which remains static in use, the inner and outer gears 20,22 are caused to rotate relative to one another. This causes hydraulic fluid to be pumped by the gerotor 18 from the first conduit 30 into the second conduit 32. As illustrated schematically in FIG. 3, during the hose extension process the hydraulic fluid is caused to flow through the valve configuration 34 from the terminal end 38 of the second conduit 32 to the terminal end 36 of the first conduit 30. When this happens, by virtue of the resistance offered to the hydraulic fluid by the flow control valve 42, the majority of the hydraulic fluid flows through the first internal conduit 44 and the check valve 40. This provides that the hydraulic fluid flows through the valve configuration 34 relatively unimpeded so that the user may extend the hose 13 with ease.

Figure 3:
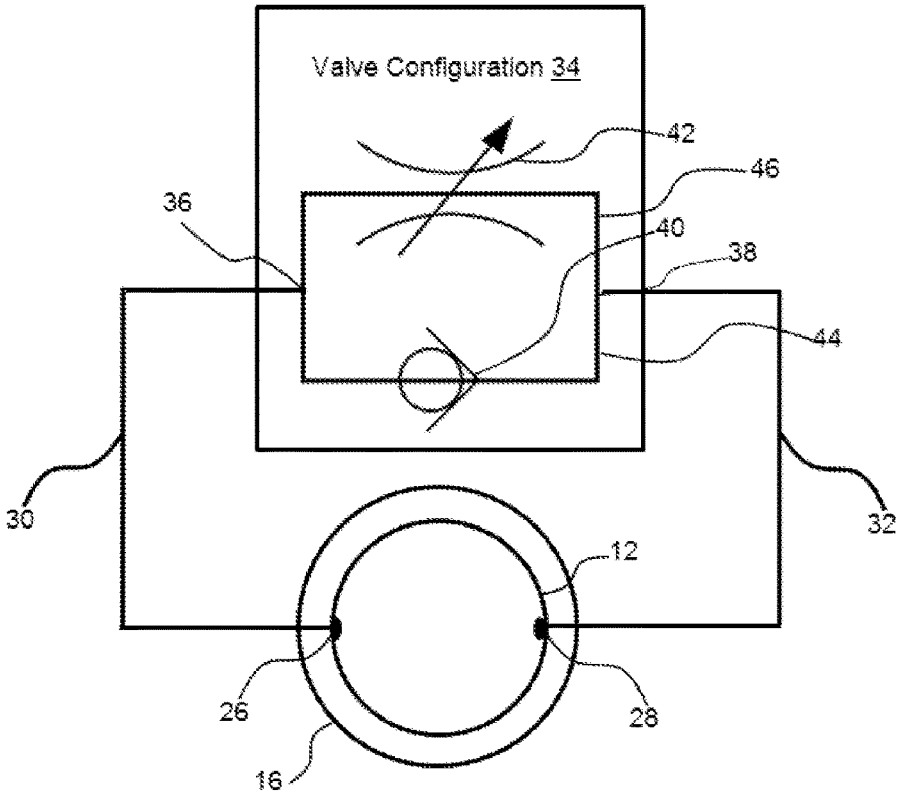
FIG. 3 is a schematic view of a hydraulic circuit that may be comprised in the braking system.

When the user has finished using the hose 13 and wishes to stow it into the reel 16, the user may slowly move the end of the hose 13 back towards the reel 16, or may let go of the hose 13 all together. Preferably, the reel 16 incorporates a retraction mechanism, such as a spring-driven retraction mechanism, which causes the drum 14 to rotate in the opposite direction thereby automatically retracting the hose 13. During this retraction process, hydraulic fluid is caused to be pumped through the gerotor 18 from the second conduit 32 into the first conduit 30. As illustrated in FIG. 3, hydraulic fluid is simultaneously caused to flow through the valve configuration 34 from the terminal end 36 of the first conduit 30 into the terminal end 38 of the second conduit 32. When this happens, because the check valve 40 does not allow the hydraulic fluid to flow through the first internal conduit 44 or check valve 40 in this direction (or may only allow a negligible amount of hydraulic fluid to flow in this direction), the majority of the hydraulic fluid is caused to flow through the second internal conduit 46 and the flow control valve 42.

The flow control valve 42, therefore, provides that a degree of resistance is offered to the flow of hydraulic fluid through the valve configuration 34 when the hose 13 is being retracted. This provides a braking force that governs a maximum rotational velocity of the drum 14 and, by extension, a maximum speed at which the hose 13 may be returned to the reel 16. The magnitude of the resistance offered is advantageously proportional to the torque that is exerted on the gerotor 18 by the retraction mechanism for an almost constant retraction speed of the hose 13. Any acceleration of the hose 13 is effectively eliminated and the retraction speed remains materially constant throughout the retraction process. Flow control valve 42 may completely restrict flow through second internal conduit 46 which may act as a lock to prevent the hose 13 from being retracted.

The retraction mechanism of some reels, such as spring-driven retraction mechanisms, may inherently have a variable retraction speed. For instance, a drum of a reel may be heavier and rotate slower when the hose 13 is retracted onto the reel. Additionally a spring-driven retraction mechanism may retract faster or slower depending on the amount of extension or compression in the spring. Example embodiments comprising a pressure compensator 240 may be advantageously fitted to provide constant flow and retraction speed for drums having such variable retraction speeds and retraction mechanisms.

The magnitude of the braking force that is applied during the retraction process may be governed by one or more features and components of the braking system 10 alone or in combination. For example, the braking force may be determined by the flow control valve 42, the size of the inlet and outlet orifices 26, 28, the diameters of the first and second conduits 30, 32, the diameters of the first and second internal conduits 36, 38 and/or a viscosity of the hydraulic fluid.

The braking system 10 advantageously enables a hose or cable to be automatically retracted into a reel in a controlled speed and manner.

Further, because the braking system 10 comprises a self-contained housing 12, the braking system 10 also may, advantageously, be retrofitted into conventional hose or cable reels 16 that do not comprise braking systems.

Further, the gerotor 18 of the braking system 10 is advantageously comprised of a minimal number of components and is compact in size. The gerotor 18 is, therefore, robust, reliable and cost effective to manufacture and can be fitted into hose reels having a wide range of different sizes, shapes and configurations.

Embodiments of the present invention provide braking systems that are useful for controlling the speed at which hoses and cables may be automatically retracted into reels. This includes large industrial hose reels and smaller hose reels used for domestic purposes.

For the purpose of this specification, the word "comprising" means "including but not limited to", and the word "comprises" has a corresponding meaning.

The above embodiments have been described by way of example only and modifications are possible within the scope of the claims that follow.

The invention claimed is:

1. A braking system for a hose or cable reel, the hose or cable reel comprising a hose or cable disposed on a rotatable drum that is configured to rotate in a first direction, to allow the hose or cable to be extended from the drum, and in a second opposite direction, to retract the hose or cable onto the drum, the braking system comprising:

a housing configured to fit inside the drum of the reel and to rotate with the drum, the housing comprising fluid inlet and outlet orifices opening into an inside of the housing;

first and second conduits in fluid communication with, respectively, the inlet and outlet orifices;

a gerotor comprising inner and outer gears disposed inside the housing, wherein the inner gear is attachable to a shaft of the reel and the outer gear is configured to rotate relative to the inner gear with the housing and the drum during use thereby causing hydraulic fluid to be pumped through the gerotor; and a valve configuration connected to respective ends of the first and second conduits, the valve configuration being configured to limit flow of the hydraulic fluid through the valve configuration from the first conduit to the second conduit upon rotation of the drum in the second direction to thereby impede rotation of the drum, and to allow the flow of the hydraulic fluid through the valve configuration from the second conduit to the first conduit upon rotation of the drum in the first direction so that the drum is able to rotate relatively unimpeded during extension of the hose or cable from the drum.

2. The braking system according to claim 1, wherein the valve configuration comprises a check valve and a flow control valve configured such that when hydraulic fluid flows through the valve configuration:

from the first conduit to the second conduit, more hydraulic fluid flows through the flow control valve than through the check valve; and from the second conduit to the first conduit, more hydraulic fluid flows through the check valve than through the flow control valve.

3. The braking system according to claim 2, wherein the check valve is configured such that hydraulic fluid cannot flow through the check valve when flowing from the first conduit to the second conduit through the valve configuration.

4. The braking system according to claim 2, wherein the valve configuration further comprises first and second internal conduits, each internal conduit being in fluid communication with the respective ends of the first and second conduits in respective communication with the inlet and outlet orifices, and wherein: the flow control valve controls the flow of hydraulic fluid through the first internal conduit; and the check valve controls the flow of hydraulic fluid through the second internal conduit.

5. The braking system according to claim 2, wherein a braking force of the braking system is governed by the flow control valve.

6. The braking system according to claim 1, wherein the valve configuration comprises a pressure compensator and a flow control valve configured such that when the hydraulic fluid flows through the valve configuration:

from the first conduit to the second conduit, the hydraulic fluid flow can be controlled by the pressure compensator; and from the second conduit to the first conduit, the hydraulic fluid flow is not controlled by the pressure compensator.

7. The braking system according to claim 6, wherein the pressure compensator comprises:

a spool, displaceable between an open position, wherein flow of the hydraulic fluid through the valve configuration is not controlled by the pressure compensator, and a closed position, wherein the hydraulic fluid is prevented from flowing through the valve configuration; and a spring, arranged to bias the spool to the open position.

8. The braking system according to claim 7, wherein the valve configuration further comprises:

a first pressure conduit in fluid communication with a first side of the flow control valve and a first end of the spool, wherein backpressure at the first side of the flow control valve generated by the hydraulic fluid flowing through the flow control valve forces the spool towards the open position; and a second pressure conduit in fluid communication with a second side of the flow control valve and a second end of the spool, wherein backpressure at the second side of the flow control valve generated by the hydraulic fluid flowing through the flow control valve forces the spool towards the closed position.

9. The braking system according to claim 1, wherein the braking system further comprises an elongate sleeve connected to the inner gear and defining an internal lumen, the internal lumen of the elongate sleeve being configured to receive the shaft, and the elongate sleeve is axially aligned so that when the shaft is received in the internal lumen of the elongate sleeve, the inner gear is securely attached to the shaft.

10. The braking system according to claim 1, wherein a braking force of the braking system is governed by a size of the inlet orifice.

11. The braking system according to claim 1, wherein a braking force of the braking system is governed by a size of the outlet orifice.

12. The braking system according to claim 1, wherein a braking force of the braking system is governed by a viscosity of hydraulic fluid flowing in the braking system.

13. The braking system according to claim 1, wherein the braking system has hydraulic fluid flowing therethrough, and the braking system hydraulic fluid comprises oil.

14. The braking system according to claim 1, wherein the housing is releasably attachable to the drum.

15. The braking system according to claim 1, wherein the housing in combination with the valve configuration comprises a non-circular shape, and wherein a majority portion of this non-circular shape is substantially cylindrical.

16. The braking system according to claim 1, wherein the housing is made of plastic.

17. The braking system according to claim 1, wherein the valve configuration and the first conduit and the second conduit are integrally formed within the housing.

18. A hose reel having a braking system according to claim 1 installed in the hose reel.

19. The hose reel of claim 18, wherein the housing of the braking system is disposed inside a drum of the hose reel.

20. A cable reel having a braking system according to claim 1 installed in the cable reel.

* * * * *